US010920414B2

(12) United States Patent
Gordon

(10) Patent No.: US 10,920,414 B2
(45) Date of Patent: Feb. 16, 2021

(54) REINFORCING STRUCTURE FOR MODULAR BUILDING CONSTRUCTION

(71) Applicant: Best GEN Modular, Inc., Rapid City, SD (US)

(72) Inventor: Allen Gordon, Brookings, SD (US)

(73) Assignee: BEST GEN MODULAR, INC., Rapid City, SD (US)

( * ) Notice: Subject to any disclaimer, the term of this patent is extended or adjusted under 35 U.S.C. 154(b) by 0 days.

(21) Appl. No.: 16/360,475

(22) Filed: Mar. 21, 2019

(65) Prior Publication Data

US 2019/0292770 A1 Sep. 26, 2019

Related U.S. Application Data

(60) Provisional application No. 62/646,122, filed on Mar. 21, 2018.

(51) Int. Cl.
*E04B 1/343* (2006.01)
*E04H 1/00* (2006.01)

(52) U.S. Cl.
CPC ..... *E04B 1/34352* (2013.01); *E04B 1/34384* (2013.01); *E04H 1/005* (2013.01)

(58) Field of Classification Search
CPC .. E04B 1/34352; E04B 1/34384; E04B 2/707; E04B 1/10; E04B 1/34321; E04H 1/005; E04H 2001/1283
See application file for complete search history.

(56) References Cited

U.S. PATENT DOCUMENTS

| | | | | |
|---|---|---|---|---|
| 2,564,691 | A * | 8/1951 | Heiles | E04B 1/10 52/641 |
| 3,540,173 | A * | 11/1970 | Johnides | E04B 1/348 52/79.5 |
| 5,724,774 | A * | 3/1998 | Rooney | E04B 1/34321 52/79.5 |
| 8,082,718 | B2 * | 12/2011 | Esbaum | E04B 1/26 52/745.13 |
| 9,169,631 | B2 * | 10/2015 | Tate | E04C 3/40 |
| 9,702,138 | B1 * | 7/2017 | Rutherford | E04B 1/34853 |
| 10,196,809 | B2 * | 2/2019 | Hall | E04B 1/14 |
| 2010/0242405 | A1 * | 9/2010 | Esbaum | E04B 1/26 52/782.1 |
| 2011/0036022 | A1 * | 2/2011 | Hsu | E04B 1/3483 52/79.1 |

(Continued)

*Primary Examiner* — Rodney Mintz
(74) *Attorney, Agent, or Firm* — Goodhue, Coleman & Owens, P.C.

(57) ABSTRACT

Modular building units comprise, prior to installation at a construction site, a floor, a ceiling, and a plurality of walls which together define a habitable interior, wherein at least one wall is a reinforced wall capable of spanning a spanning distance of at least 50 feet without underlying support. In some embodiments, reinforced walls comprise one or more reinforcing structures. In some embodiments, the spanning distance is at least 60 feet; in some, at least 70 feet; and in some, at least 80 feet. In a further aspect, a method of building construction comprises the steps of: a) constructing a modular building unit according to the present disclosure at an assembly site; b) transporting the modular building unit to a construction site; and c) installing the modular building unit at the construction site, optionally across a unsupported span of at least 50 feet.

17 Claims, 16 Drawing Sheets

(56) References Cited

U.S. PATENT DOCUMENTS

| | | | | |
|---|---|---|---|---|
| 2011/0173907 | A1* | 7/2011 | Katsalidis | E04B 1/3483 52/236.3 |
| 2014/0137485 | A1* | 5/2014 | Lafferty, III | E06B 9/04 52/29 |
| 2014/0260024 | A1* | 9/2014 | Tate | E04C 3/40 52/299 |
| 2014/0345217 | A1* | 11/2014 | Horton, III | E04B 1/644 52/293.1 |
| 2015/0322668 | A1* | 11/2015 | Quinn | E04B 1/24 52/236.9 |
| 2016/0024779 | A1* | 1/2016 | Clus | E04B 1/19 52/79.1 |
| 2016/0348369 | A1* | 12/2016 | Godfrey | E04B 1/2604 |
| 2017/0159290 | A1* | 6/2017 | Albright | E04B 5/023 |
| 2017/0198489 | A1* | 7/2017 | Klein | E04H 9/04 |
| 2018/0355603 | A1* | 12/2018 | Hall | E04B 1/14 |
| 2019/0234063 | A1* | 8/2019 | Garcia-Abril Ruiz | E04B 1/14 |
| 2019/0376303 | A1* | 12/2019 | Wolff | E04B 1/34321 |

* cited by examiner

REINFORCING STRUCTURE FOR MODULAR BUILDING CONSTRUCTION

CROSS REFERENCE TO RELATED APPLICATIONS

This application claims the benefit of U.S. Provisional Application No. 62/646,122, filed Mar. 21, 2018, entitled "REINFORCING STRUCTURE FOR MODULAR BUILDING CONSTRUCTION", the entire contents of which are incorporated herein by reference.

SUMMARY OF THE DISCLOSURE

This disclosure relates modules used in modular building construction and reinforcing structures which may be integrated into such modules. The reinforcing structure may be used to increase the structural integrity and strength of the module and enable it to span greater distances without support from below, such as walls, columns, posts, piers, beams, girders, or trusses. In some embodiments, the reinforcing structure may enable the module to span greater distances without support from elements underneath the module.

In one aspect, modular building units are provided comprising, prior to installation at a construction site, a floor, a ceiling, and a plurality of walls which together define a habitable interior, wherein at least one wall is a reinforced wall capable of spanning a spanning distance of at least 50 feet without underlying support. In some embodiments, modular building units comprises two or more reinforced walls. In some embodiments, reinforced walls comprise one or more reinforcing structures. In some embodiments, reinforcing structures comprise vertical posts; in some embodiments, diagonal members; and in some embodiments reinforcing structures comprise vertical posts and diagonal members joined to adjacent vertical posts.

In some embodiments the reinforced wall comprises metal elements that span the spanning distance, and in other embodiments no metal elements that span the spanning distance. In some embodiments the reinforced wall comprises construction concrete elements that span the spanning distance, and in other embodiments no construction concrete elements that span the spanning distance. In some embodiments, the spanning distance is at least 60 feet; in some, at least 70 feet; and in some, at least 80 feet. In some embodiments, the ceiling and at least one wall comprise an interior surface 40 selected from SHEETROCK (e.g., drywall or gypsum board), tile, or finished wood paneling prior to installation at a construction site. In some embodiments, the modular building units additionally comprise, prior to installation at a construction site, installed hardware for at least one of electrical, plumbing, telephone, cable TV, internet, or HVAC service.

In a further aspect, the present disclosure provides a habitable building comprising two or more modular building units according to the present disclosure installed across a spanning distance without underlying support, where the spanning distance is at least 50 feet; in some embodiments at least 60 feet; in some, at least 70 feet; and in some, at least 80 feet.

In a further aspect, the present disclosure provides a method of building construction comprising the steps of: a) constructing a modular building unit according to the present disclosure at an assembly site; b) transporting the modular building unit to a construction site; and c) installing the modular building unit at the construction site. In some embodiments step c) comprises installing the modular building unit across an unsupported span of at least 50 feet; in some at least 60 feet; in some, at least 70 feet; and in some, at least 80 feet.

In some embodiments of the present disclosure, "prior to installation at a construction site" can be read as "prior to transporting the modular building unit from an assembly site to a construction site". In some embodiments of the present disclosure, "prior to installation at a construction site" can be read as "prior to transporting the modular building unit from an assembly site".

The preceding summary of the present disclosure is not intended to describe each embodiment of the present invention. The details of one or more embodiments of the invention are also set forth in the description below. Other features, objects, and advantages of the invention will be apparent from the description and from the claims.

All scientific and technical terms used herein have meanings commonly used in the art unless otherwise specified.

As used in this specification and the appended claims, the singular forms "a", "an", and "the" encompass embodiments having plural referents, unless the content clearly dictates otherwise.

As used in this specification and the appended claims, the term "or" is generally employed in its sense including "and/or" unless the content clearly dictates other-wise.

As used herein, "have", "having", "include", "including", "comprise", "comprising" or the like are used in their open ended sense, and generally mean "including, but not limited to." It will be understood that the terms "consisting of" and "consisting essentially of" are subsumed in the term "comprising," and the like.

DETAILED DESCRIPTION

Figure 1:
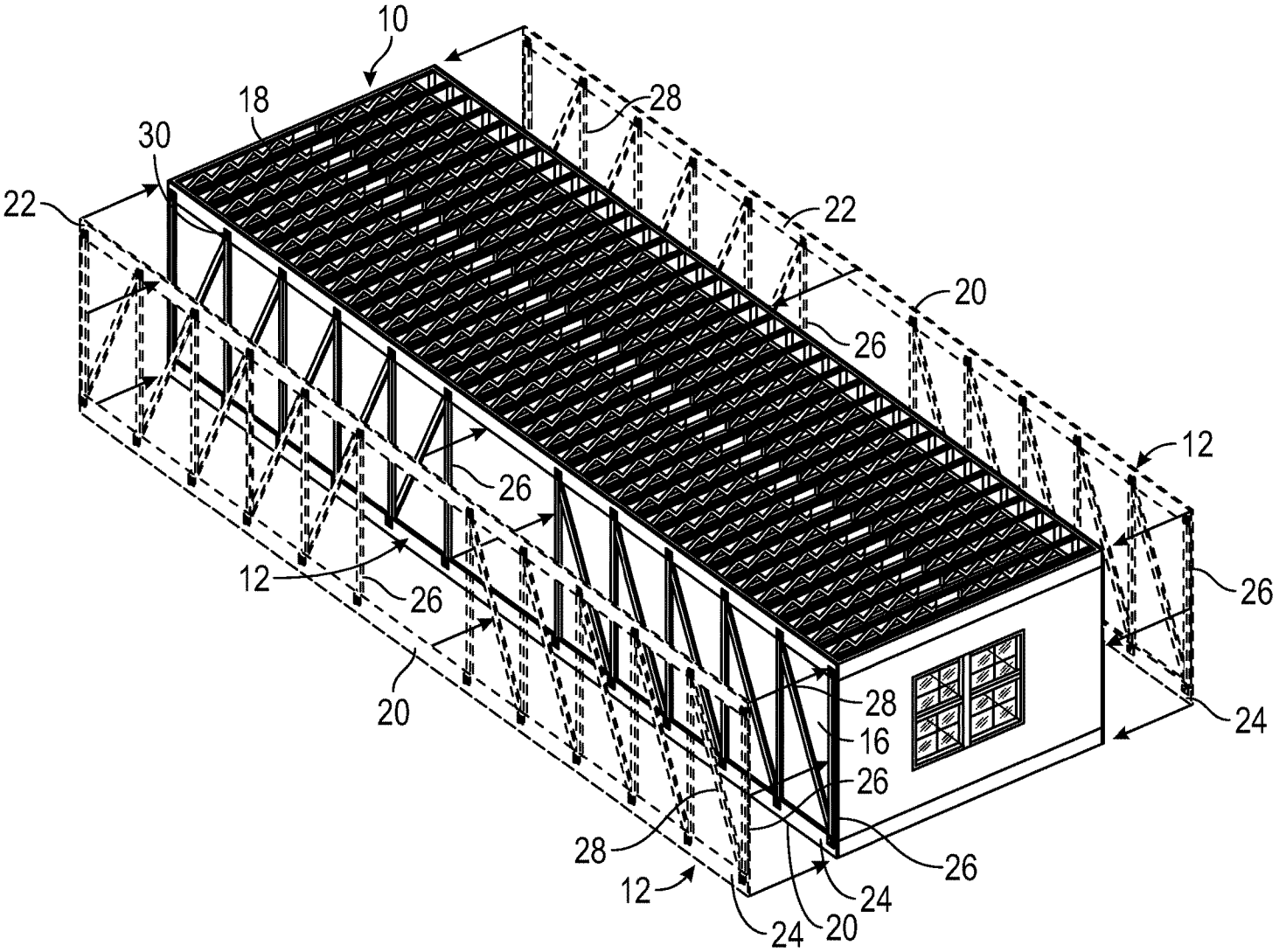
FIG. 1 is an isometric view of a module with an embodiment of a reinforcing structure of the present disclosure being applied.
Figure 2:
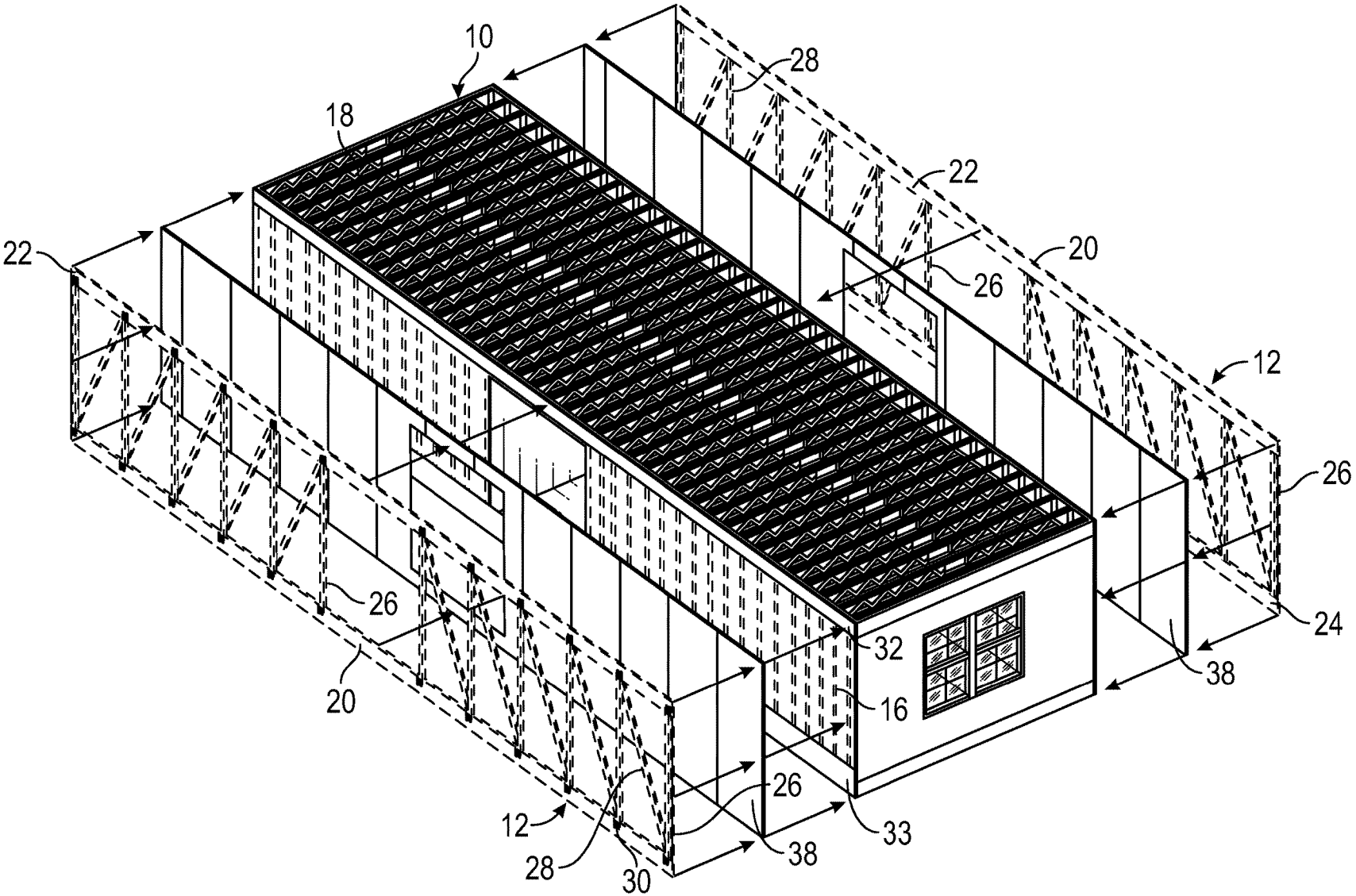
FIG. 2 is an isometric view of a module with sheathing and an embodiment a reinforcing structure of the present disclosure being applied.
Figure 3:
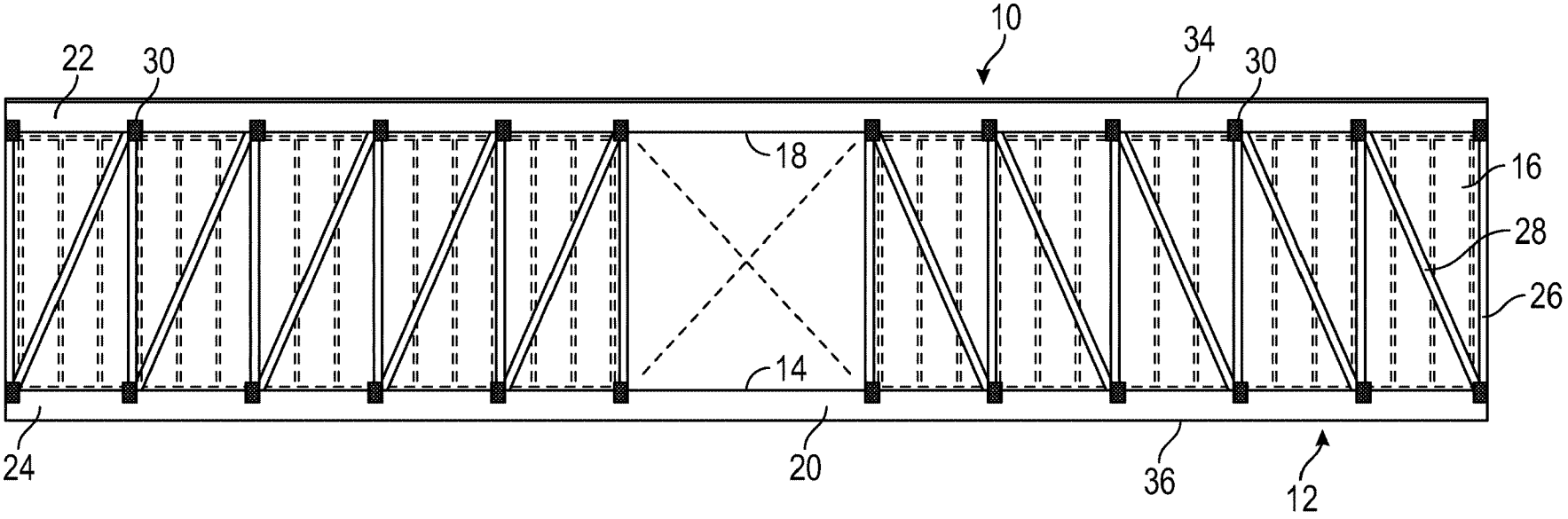
FIG. 3 is a side view of a module with an embodiment of a reinforcing structure of the present disclosure.
Figure 4:
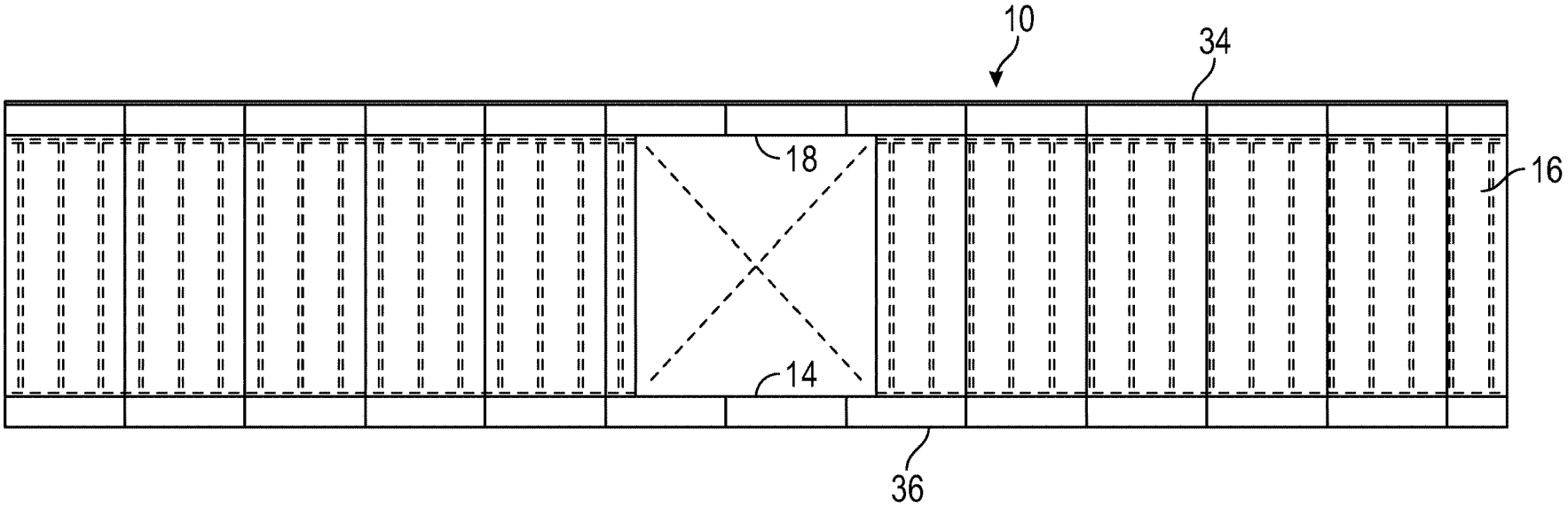
FIG. 4 is a side view of a module with sheathing, prior to reinforcing structure being applied.
Figure 5:
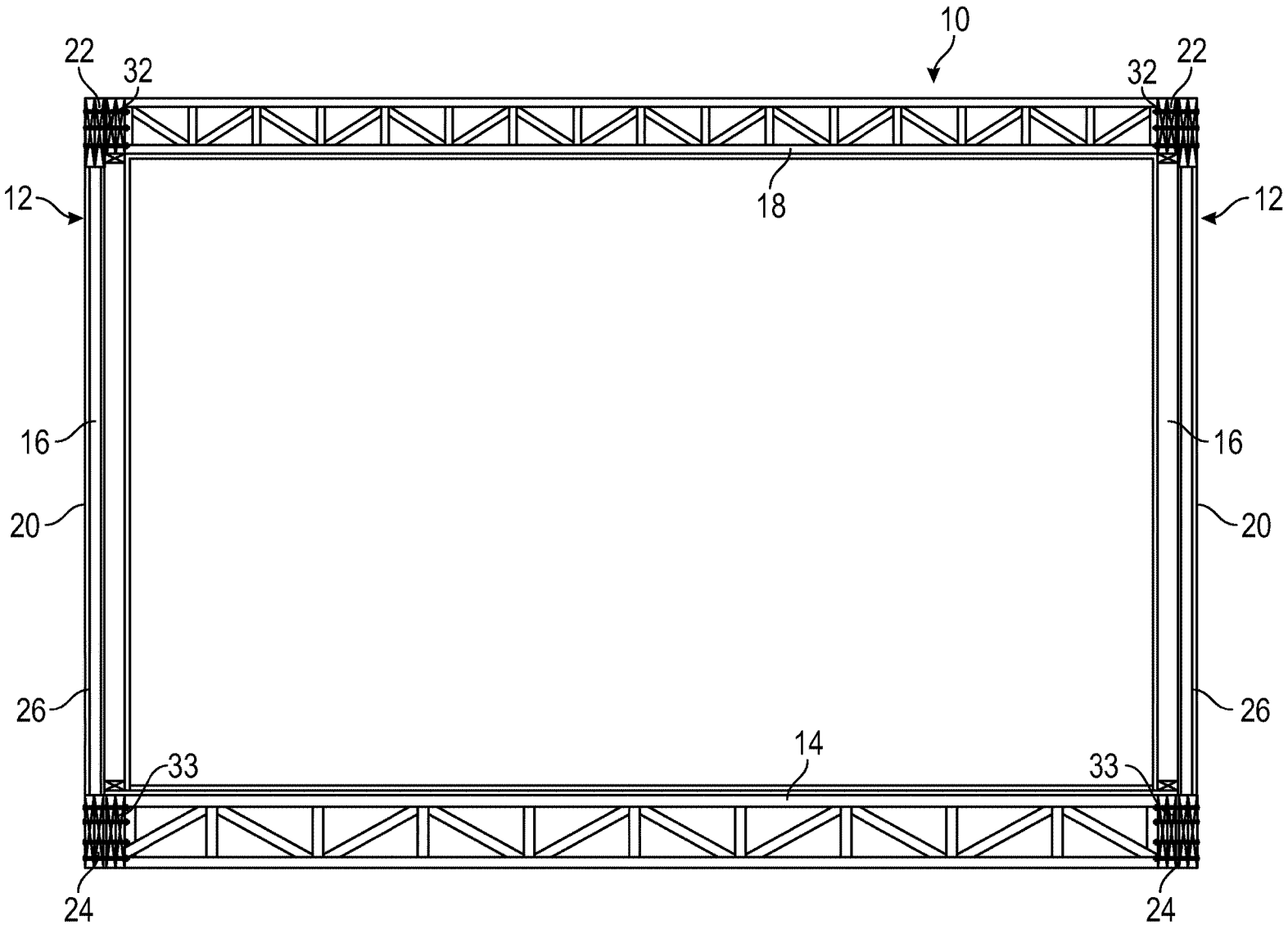
FIG. 5 is a cross-section view of module with embodiments of reinforcing structures according to the present disclosure applied to left and right walls.
Figure 6A:
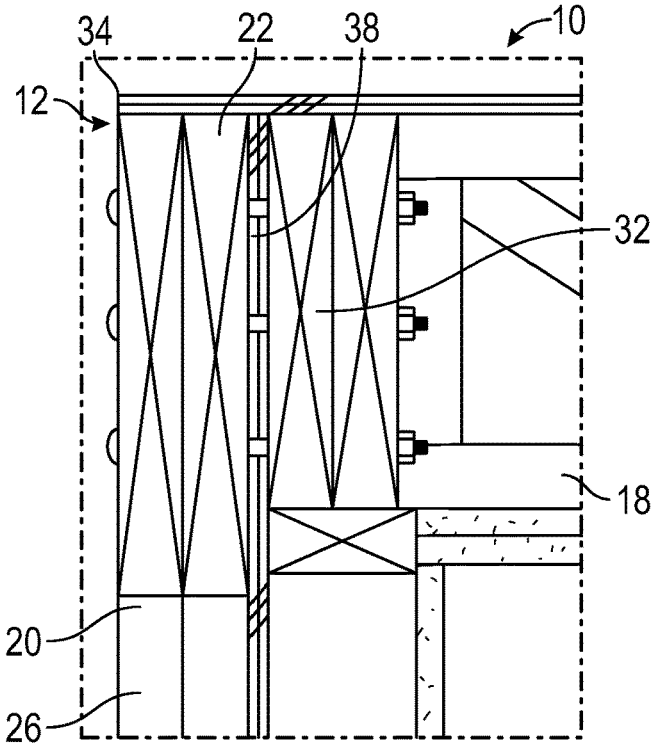
FIGS. 6A and 6B are enlarged views of the upper left and lower left corners of the embodiment of the present reinforcing structure represented in FIG. 5.
Figure 6B:
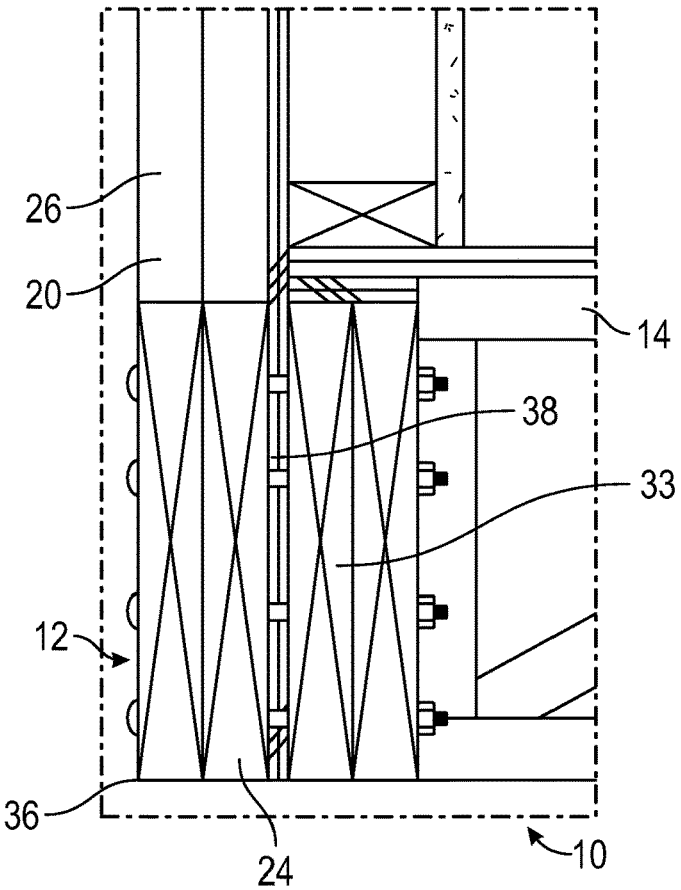
Figure 7:
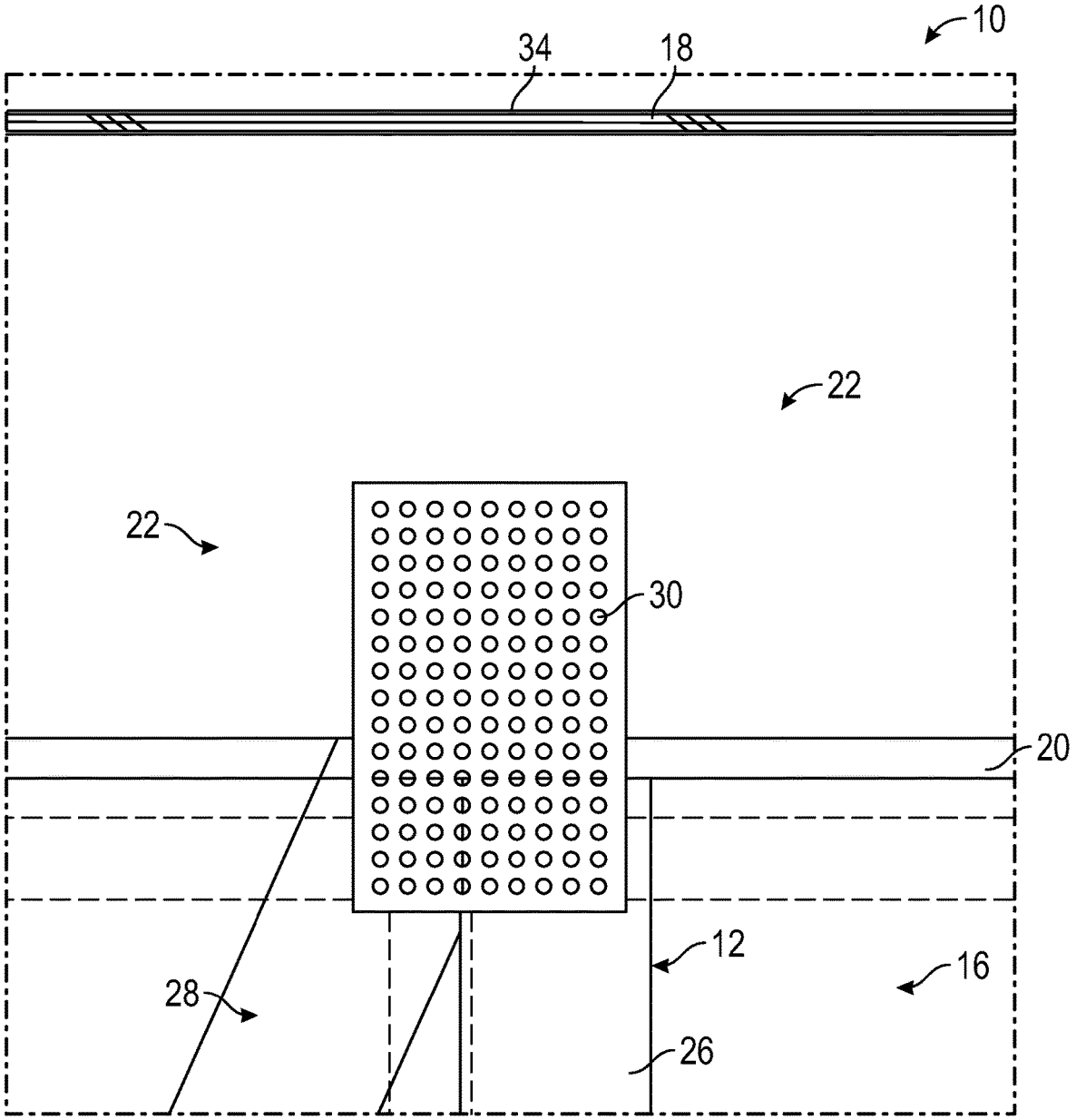
FIG. 7 is an enlarged view of an intersection of reinforcing elements of the embodiment of the present reinforcing structure represented in FIG. 3.
Figure 8:
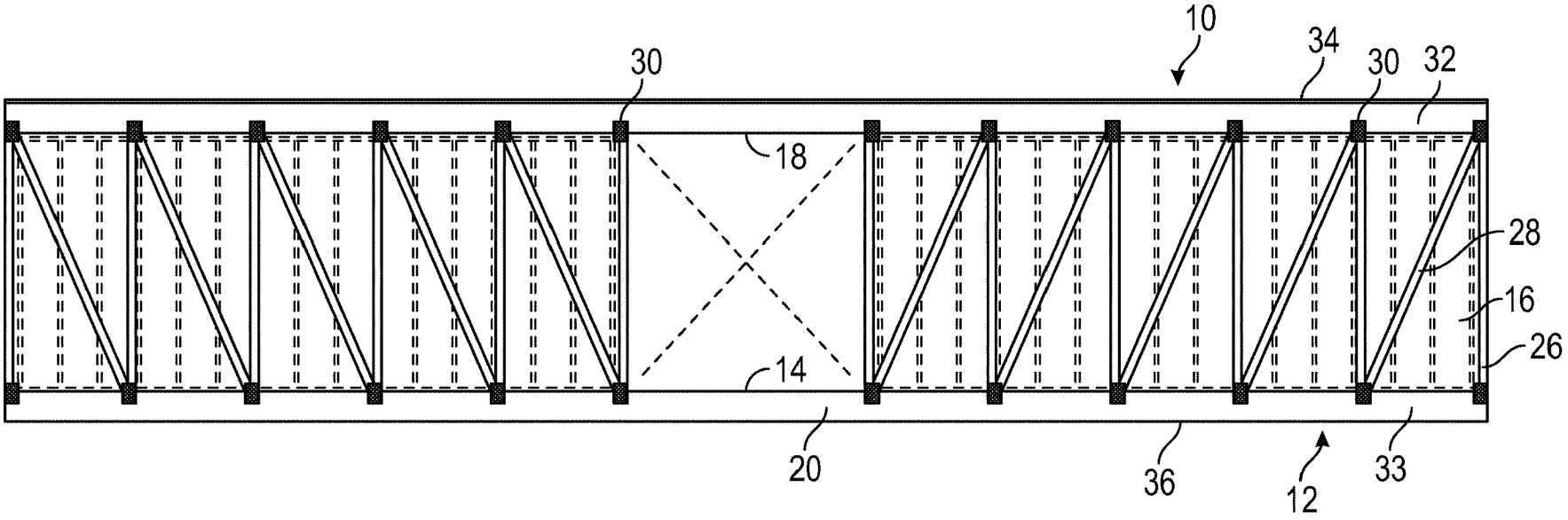
FIG. 8 is a view of an alternate embodiment of a reinforcing structure according to the present disclosure.
Figure 9:
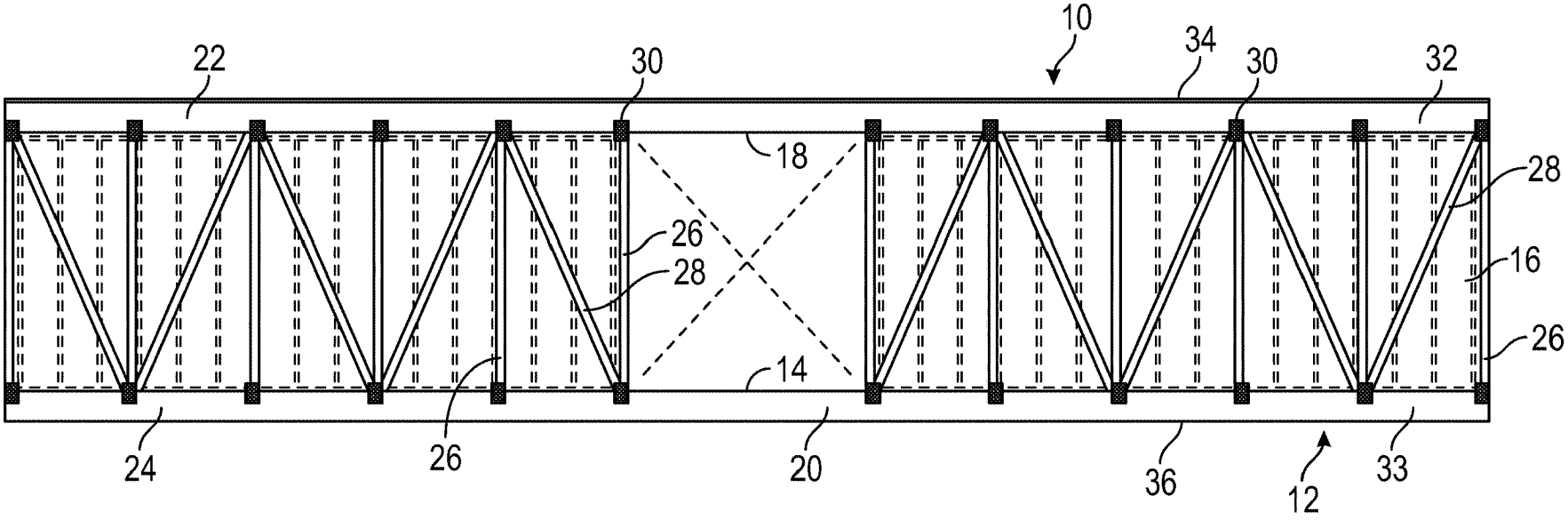
FIG. 9 is a view of an alternate embodiment of a reinforcing structure according to the present disclosure.
Figure 10:
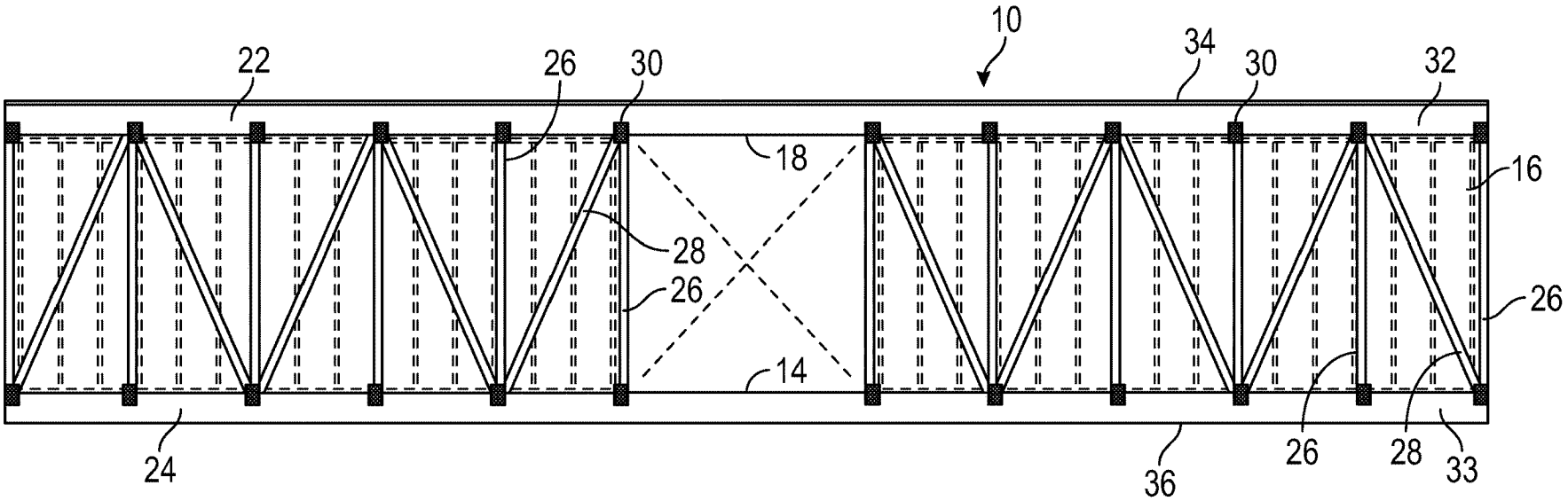
FIG. 10 is a view of an alternate embodiment of a reinforcing structure according to the present disclosure.
Figure 11:
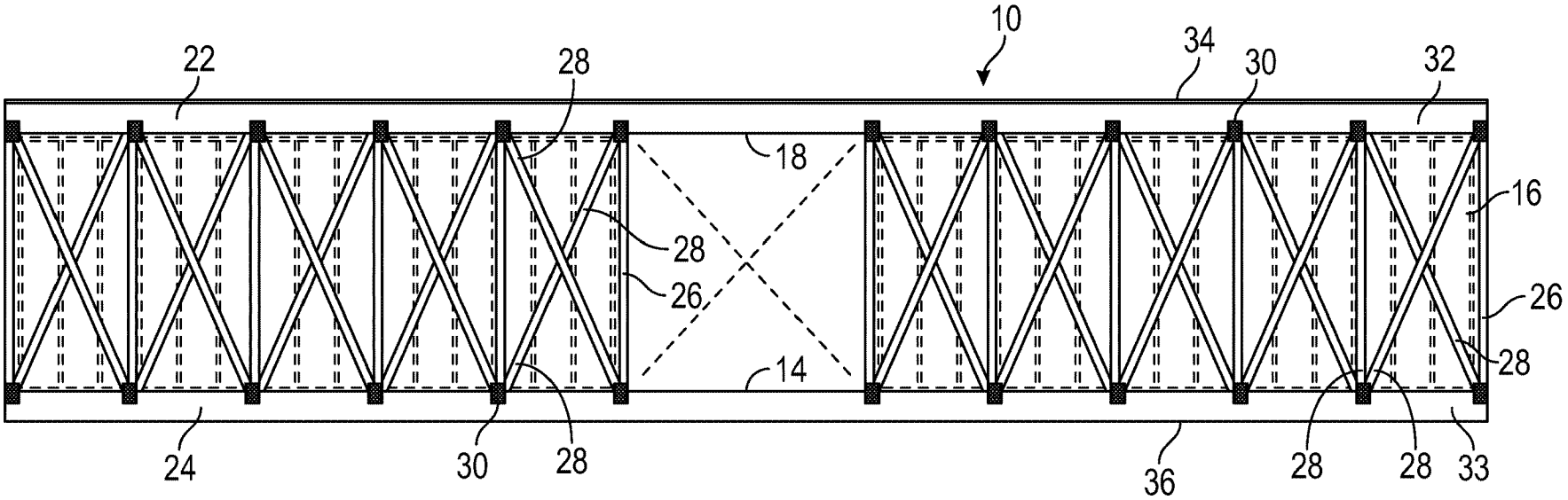
FIG. 11 is a view of an alternate embodiment of a reinforcing structure according to the present disclosure.
Figure 12:
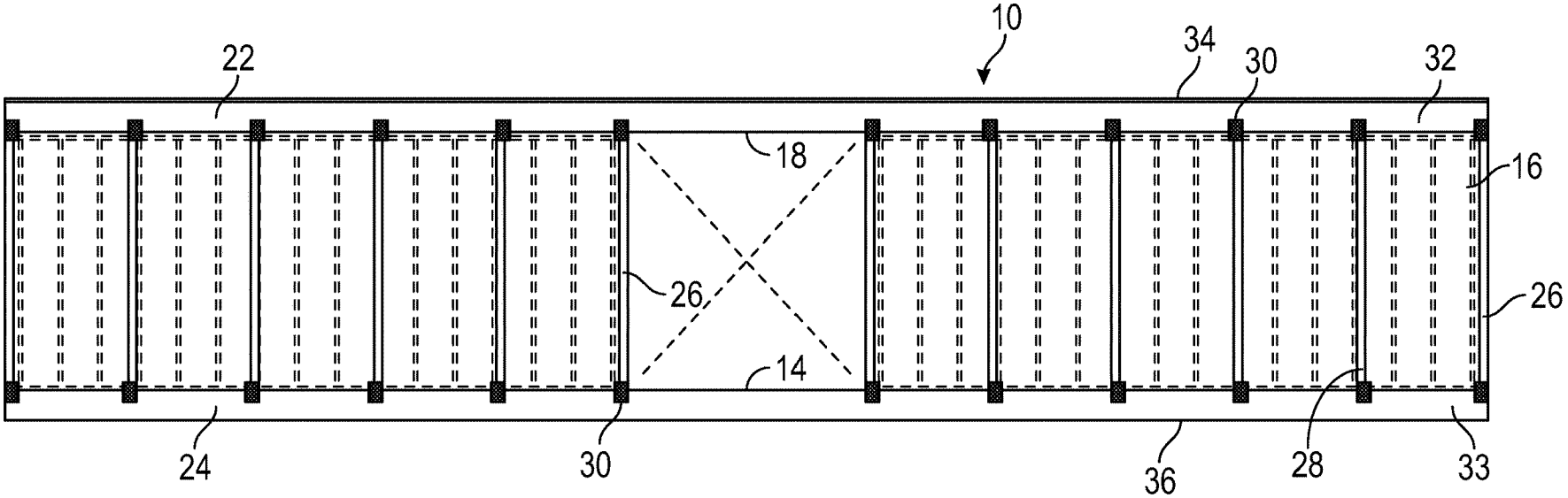
FIG. 12 is a view of an alternate embodiment of a reinforcing structure according to the present disclosure.
Figure 13:
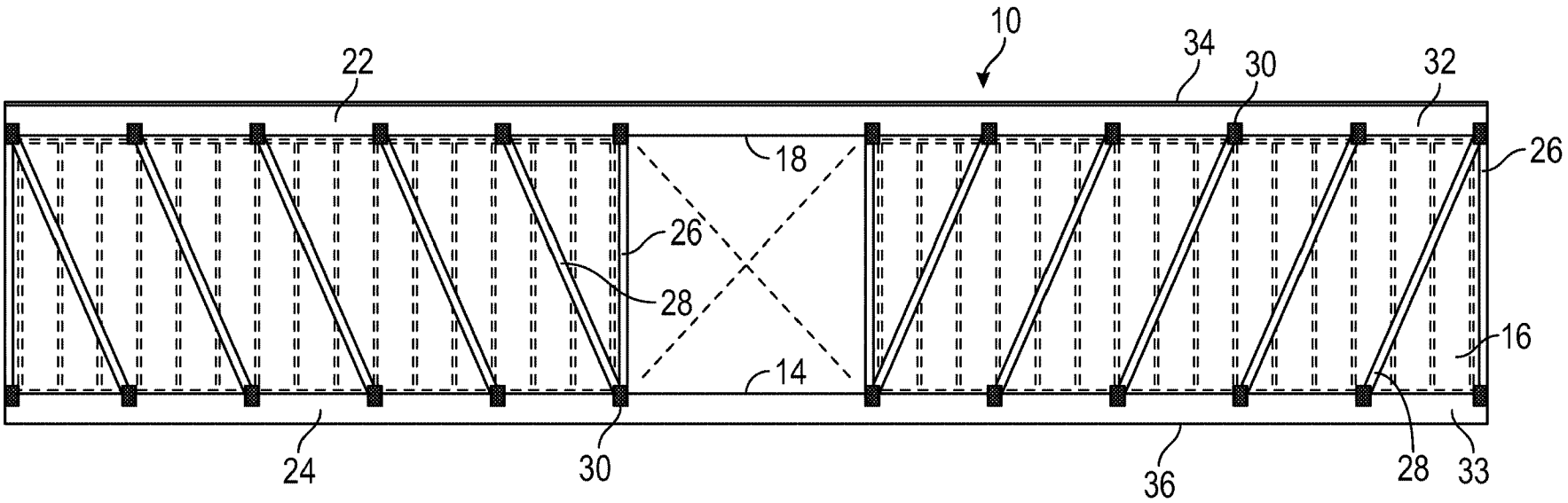
FIG. 13 is a view of an alternate embodiment of a reinforcing structure according to the present disclosure.
Figure 14:
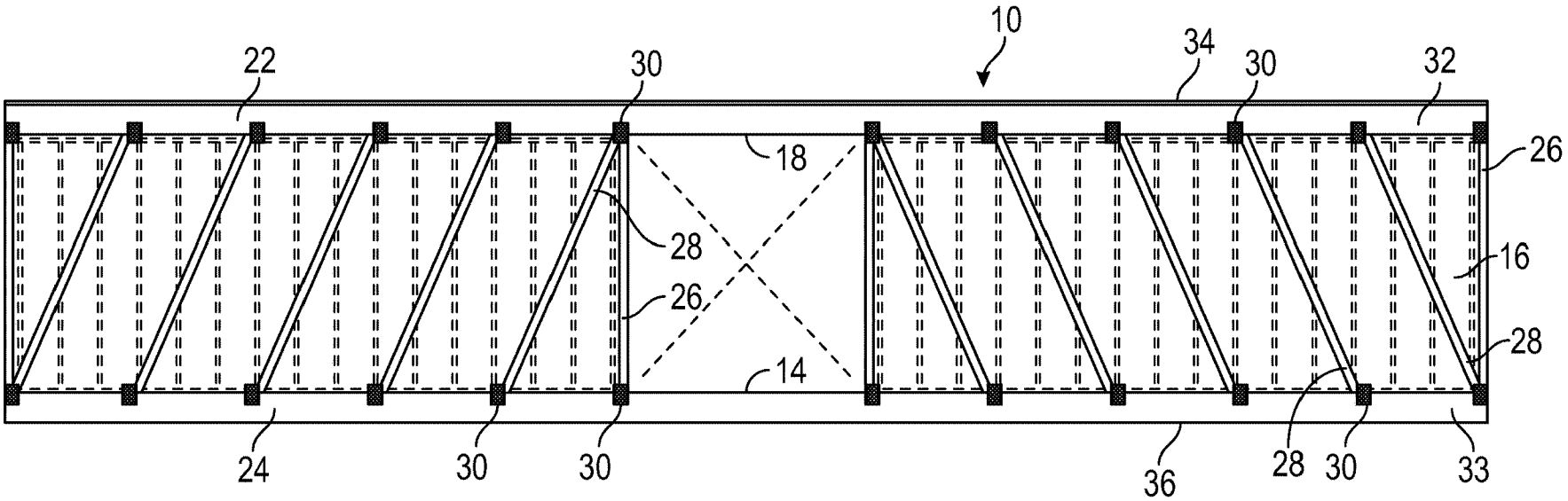
FIG. 14 is a view of an alternate embodiment of a reinforcing structure according to the present disclosure.
Figure 15:
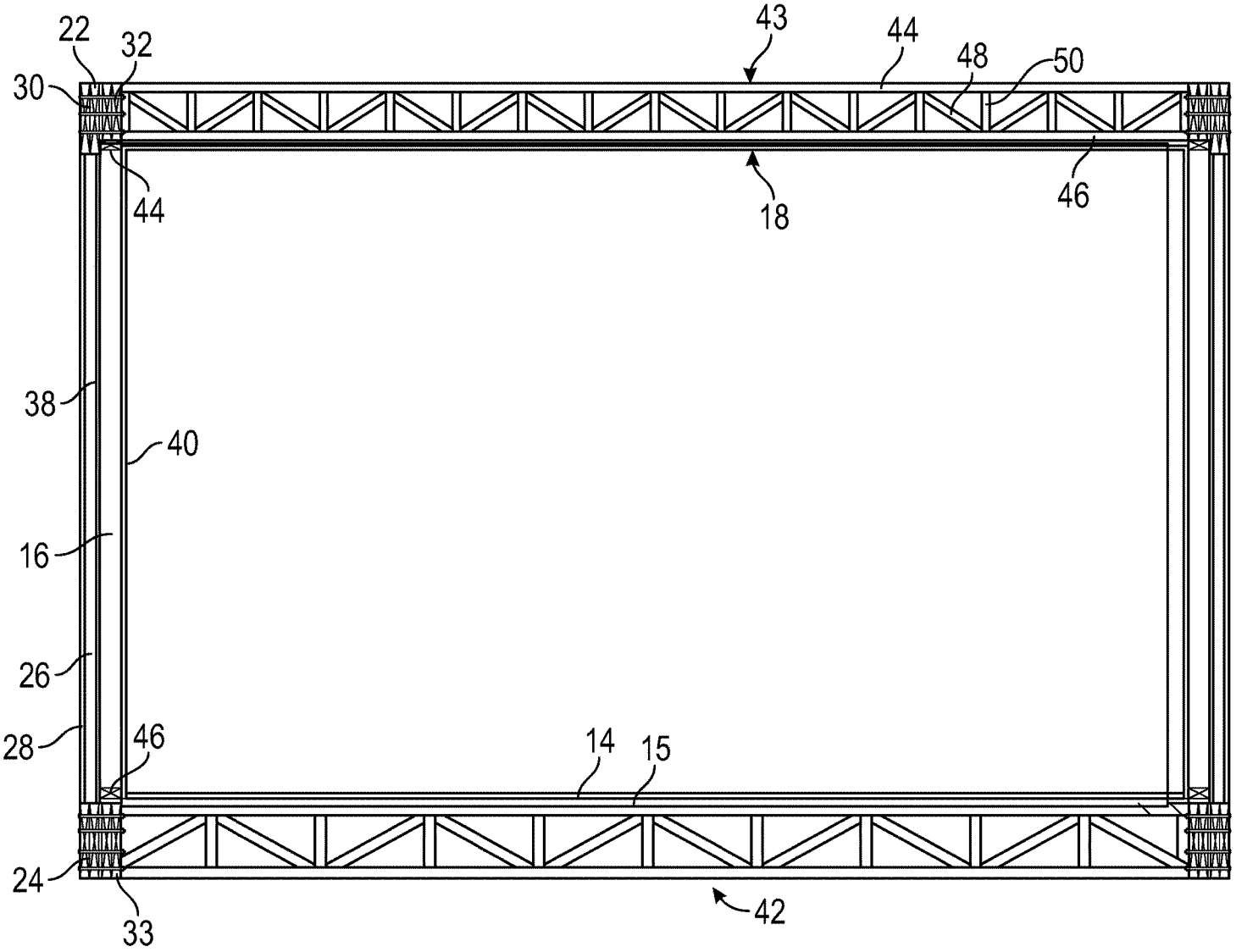
FIG. 15 is a cross-section view of module with embodiments of reinforcing structures according to the present disclosure applied to left and right walls, addition-ally indicating terminology for elements of the module and reinforcing structures.
Figure 16:
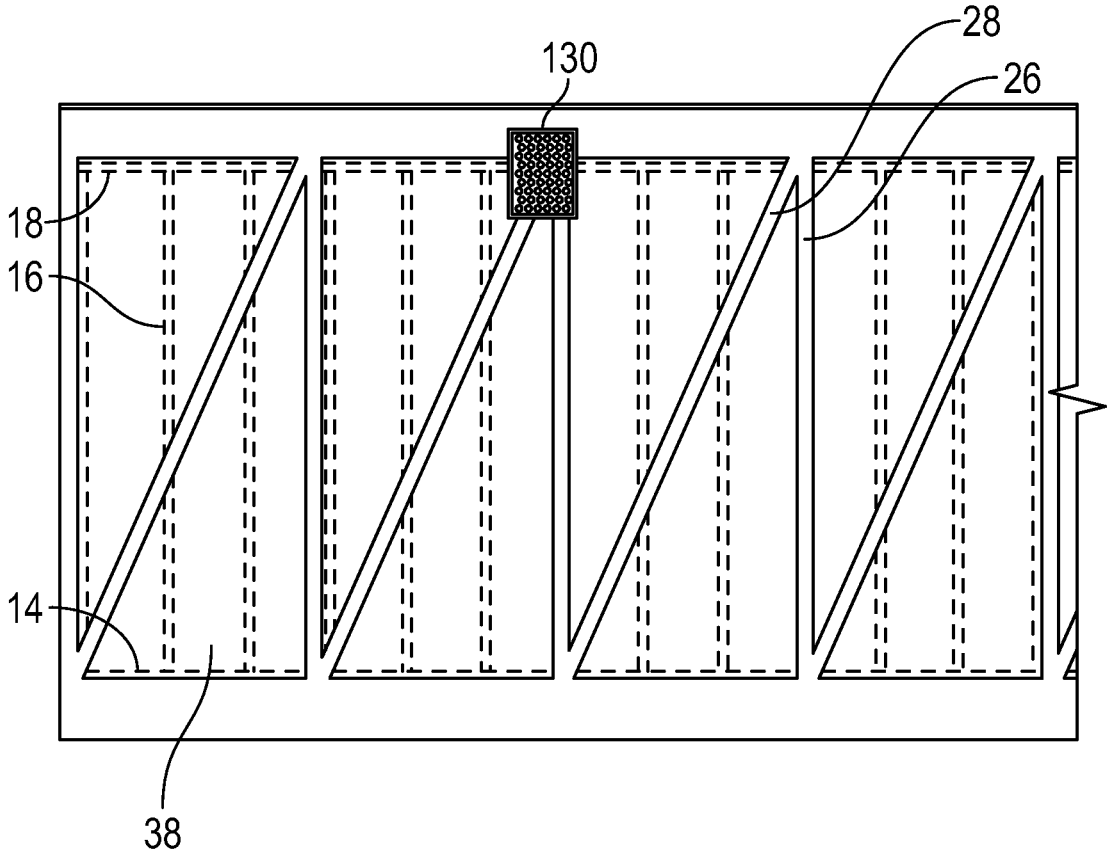
FIG. 16 is a view of an embodiment of a reinforcing structure according to the present disclosure installed on a module, additionally indicating terminology for elements of the module and reinforcing structure.

The present disclosure provides modules used in modular 10 building construction and reinforcing structures 12 which may be integrated into modules 10 used in modular building construction. The reinforcing structures 12 may be used to increase the structural integrity and strength of the module 10 and enable it to span greater distances without building framing and structural support from below, such as walls, columns, posts, piers, beams, girders, or trusses.

The modular building construction method utilizes "modules" produced in a factory environment that are assembled into the final building configuration at the construction site. These modules 10 may consist of one or more habitable rooms in which the floor 14 (typically plywood), walls 16 (typically 2×4 for internal wall; typically 2×6 for exterior wall) having a top plate 44, opposing bottom plate 46 and sheathing 38 (typically chipboard or oriented strand board "OSB"), subfloor (typically "OSB"), floor truss 42 and ceiling 18 having a ceiling truss 43, top chord 44 (compression chord), bottom chord 46 (tension chord), diagonal 48, and post 50 are preassembled at a production facility, transported to the construction site, and then moved into their final position and fastened together before the exterior of the building is applied to the assembled modules 10. The degree to which the modules are finished at the production facility may vary, but can include installation, texturing, and painting of walls and ceilings; installation and finishing of doors, windows, and decorative trim; installation of carpet, tile, and other flooring; installation of lights, switches, outlets, plumbing, and HVAC (heating, ventilation, and air conditioning) systems; and installation of cabinets, counters and countertops, and even certain furniture and furnishings. In contrast, traditional site-built or stick-built construction requires delivering all of the necessary materials to the construction site where individual components and materials are fabricated and assembled into the final structure at the site, and specialized crews are hired to complete the installation of the aforementioned items and systems. Significant advantages of modular construction include performing the work in an enclosed facility protected from weather and the elements; efficiencies and improved quality arising from working in a factory setting with the assistance of tools and machinery that is not practical at an outdoor work site; and lower costs, shorter time to occupancy, and improved cash flow for the building owner resulting from these efficiencies and avoiding the need to hire skilled trade crews to work at the construction site.

Proper support for the individual modules 10 is vital to ensuring the building maintains its structural integrity over time and provides a safe and pleasant environment for its occupants. This support may be provided in various ways, including a slab on grade in which the modules 10 rest directly on a concrete slab at ground level, a below-grade basement or crawl space in which the modules are supported by a foundation and vertical walls, or a "podium" in which the first floor is constructed using traditional non-modular building techniques and the modules are placed on top of the first floor podium. The modules may comprise a single story, or may be stacked on top of one another to create a structure several stories tall.

In certain building designs, it may be desirable to create large open spaces. Examples from residential construction include living or recreational spaces in a single-family home or multi-family apartment building or condominium. In commercial construction, examples include areas such as hotel lobbies, conference rooms or ballrooms, and indoor swimming pools where support structures including walls, columns, and piers would interfere with the activity taking place in the space or detract from the aesthetics and visual appeal of the facility. Alternatives to walls, columns, and piers exist and may include structural elements like laminated wood beams or steel beams, girders, and trusses over the open space to provide support for the building structure above the open space. These alternatives are very expensive, require structural analysis to ensure their adequacy, and require costly crews, equipment, and time to install them properly while the building is being constructed.

The present disclosure concerns structures 12 and methods to provide support over large open spaces in a construction module 10. While individual modules 10 used in modular building construction must be robustly constructed to withstand the rigors of being transported from the production facility to the construction site, the integration of a reinforcing structure 12 to the completed module 10 can further increase the rigidity and structural integrity and strength of the module 10 to the point where it no longer requires support from below and can span such large open spaces without disruptive walls, columns or piers or costly beams, girders, or trusses. By integrating a reinforcing structure 12 with the perimeter walls 16 of an individual module 10, the entire module 10 becomes a structural truss capable of spanning large open spaces without interior support elements. This reinforcing structure 12 may take the form of a truss comprised of a top chord 22, bottom chord 24, vertical posts 26 (typically 2×4), diagonals 28 (typically 2×4), and reinforcing structure fastener 30 means (typically bolts/nuts, lag bolts, screws, nails, or adhesive) to connect said elements together, such as a metal connecting plate at each intersection of elements as shown in the Figures. Alternately, the top chord 22, bottom chord 24, or both chords 22, 24 may be eliminated, and the vertical posts 26 and diagonals 28 may be integrated directly to the existing horizontal top rim joist 32 (typically doubled-up 2×10) and bottom rim joist 33 (typically doubled-up 2×12) that form the top 34 and bottom perimeter 36 of the module. In this case, the top rim joist 32 serves as the top chord (compression chord) of the truss 20 and the bottom rim joist 33 serves as the bottom chord (tension chord) of the truss 20. This structure withstands the tensile and compressive forces necessary to prevent the module 10 from sagging downward, thereby eliminating the need for the aforementioned underlying supports such as walls, columns, piers, beams, girders, and trusses.

Any suitable materials may be used to construct the reinforcing structure 12 according to the present disclosure. The diagonal 28 and vertical 26 members may be dimensional lumber such as 2×4 s or 2×6 s, metal bars or rods, wound or woven cable, metal strapping, or other materials capable of withstanding the tensile and compressive caused by the force of gravity acting on the module 10, or any combination thereof. Any suitable mechanism for integrating the diagonal 29 and vertical 26 members and optional top 22 and bottom 24 chords with the rest of the module may be used, including bolts and nuts, lag bolts, screws, nails, and/or structural adhesives.

Depending on the length of the module 10 spanning the open space beneath it and the number of stories above the module 10, the number of reinforcing structures 12 integrated to the module in layer-like fashion may be varied from zero to several (i.e. more reinforcing structures 12 used on longer modules or modules 10 positioned on lower floors of a building with significant loading from above, and fewer or no reinforcing structures 12 on shorter modules 10 or those positioned on higher floors with comparatively less loading from above). Furthermore, where a foundation and load-bearing walls may provide sufficient support under one side of a module 10, it may be necessary to integrate one or more reinforcing structures 12 with one perimeter wall of a module while one or more of the other perimeter walls 16 of a module 10 may not require such a reinforcing structure at all.

In some embodiments, use of the reinforcing structures 12 according to the present disclosure can avoid the need for structural elements such as laminated wood beams or steel beams, girders, and trusses across the top of the open space to provide support for the building structure above the open space which are expensive, require structural analysis, and require costly crews, equipment, and time to install them properly while the building is being constructed.

In some embodiments, use of the reinforcing structures 12 according to the present disclosure can enable the use of module construction in designs which might otherwise require site-built construction. Modules 10 can be set in place more quickly and efficiently than a site-built building can be constructed to span large open spaces. Thus use of the reinforcing structures 12 according to the present disclosure can enable speedier construction, shortening time to occupancy, and improving cash flow for the building owner.

In some embodiments, the reinforcing structures 12 according to the present disclosure incorporate rim joists 32, 33 that are already present in the module construction to serve as the top and bottom horizontal members 22,24 of the reinforcing structure 12 thereby minimizing the additional materials and cost of the reinforcing system.

Various modifications and alterations of this disclosure will become apparent to those skilled in the art without departing from the scope and principles of this disclosure, and it should be understood that this disclosure is not to be unduly limited to the illustrative embodiments set forth hereinabove.

I claim:

1. A modular building unit, comprising:

a floor and a ceiling interconnected by opposing side walls and opposing end walls, which together define a habitable interior;

a plurality of floor trusses disposed within the floor;

a plurality of ceiling trusses disposed within the ceiling;

a plurality of wall studs disposed within the opposing side walls and opposing end walls;

opposing top rim joists attached to opposing ends of the plurality of ceiling trusses;

opposing bottom rim joists attached to opposing ends of the plurality of floor trusses;

a side wall reinforcing structure comprising:

opposing top chords attached to the opposing top rim joists;

opposing bottom chords attached to the opposing bottom rim joists;

at least one diagonal reinforcing member attached between the top chord and bottom chord of at least one of the opposing side walls; and at least one vertical reinforcing member attached between the top chord, bottom chord and diagonal reinforcing member of at least one of the opposing side walls;

wherein the side wall reinforcing structure is disposed between the opposing end walls along an external portion of at least one of the opposing side walls and wherein the at least one diagonal reinforcing member is a plurality of diagonal reinforcing members comprising first and second sets of diagonal reinforcing members positioned in overlapping relation, wherein the diagonal reinforcing members of the first set and the second set are intermittently disposed between the opposing end walls across the at least one of the opposing side walls.

2. The modular building unit of claim 1, further comprising:

sheathing attached to the opposing side walls and opposing end walls.

3. The modular building unit of claim 1, wherein the diagonal reinforcing members of the first and second set intersect.

4. The modular building unit of claim 1, further comprising:

wherein the diagonal reinforcing members of the first set are positioned in parallel relation to one another;

wherein the diagonal reinforcing members of the second set are positioned in parallel relation to one another;

wherein the diagonal reinforcing members of the first set are not parallel to the second set.

5. The modular building unit of claim 4, further comprising:

a first set of the at least one vertical reinforcing member attached to the first set of the at least one diagonal reinforcing member, wherein vertical reinforcing members of the first set are parallel;

a second set of the at least one vertical reinforcing members attached to the second set of the at least one diagonal reinforcing members, wherein the vertical reinforcing members of the second set are parallel;

wherein the vertical reinforcing members of the first and second set are parallel.

6. The modular building unit of claim 4, wherein the diagonal reinforcing members of the first set have top ends angled toward top ends of the diagonal reinforcing members of the second set and wherein the diagonal reinforcing members of the first set have bottom ends angled away from bottom ends of the diagonal reinforcing members of the second set.

7. The modular building unit of claim 4, wherein the diagonal members of the first set have top ends angled away from top ends of the diagonal reinforcing members of the second set and wherein the diagonal reinforcing members of the first set have bottom ends angled toward bottom ends of the diagonal reinforcing members of the second set.

8. The modular building unit of claim 1, wherein the diagonal reinforcing members of the first and second set are disposed in non-parallel relation to one another.

9. The modular building unit of claim 8, wherein the diagonal reinforcing members of the first set have top ends connected to top ends of the diagonal reinforcing members of the second set.

10. The modular building unit of claim 8, wherein the diagonal reinforcing members of the first set have bottom ends connected to bottom ends of the diagonal reinforcing members of the second set.

11. The modular building unit of claim 8, wherein the diagonal reinforcing members of the first set have top ends connected to top ends of a first set of the at least one vertical reinforcing member, and wherein the vertical reinforcing members of the first set extend between the opposing end walls across at least one of the opposing side walls.

12. The modular building unit of claim 8, wherein the diagonal reinforcing members of the second set have top ends connected to top ends of a first set of the at least one vertical reinforcing member, and wherein the vertical reinforcing members of the second set extend between the opposing end walls across at least one of the opposing side walls.

13. The modular building unit of claim 8, further comprising:

a first set of intersecting reinforcing members comprising:

a top end of the diagonal reinforcing member of the first set, a top end of the diagonal reinforcing member of the second set and a top end of at least one vertical reinforcing member.

14. The modular building unit of claim 8, further comprising:

a second set of intersecting reinforcing members comprising:

a bottom end of the diagonal reinforcing member of the first set, a bottom end of the diagonal reinforcing member of the second set and a bottom end of at least one vertical reinforcing member.

15. A modular building unit, comprising:

a floor and a ceiling interconnected by opposing side walls and opposing end walls, which together define a habitable interior;

a plurality of floor trusses disposed within the floor;

a plurality of ceiling trusses disposed within the ceiling;

a plurality of wall studs disposed within the opposing side walls and opposing end walls;

opposing top rim joists attached to opposing ends of the plurality of ceiling trusses;

opposing bottom rim joists attached to opposing ends of the plurality of floor trusses;

a side wall reinforcing structure connected to an external portion of at least one of the opposing side walls, the side wall reinforcing structure comprising:

opposing top chords attached to the opposing top rim joists;

opposing bottom chords attached to the opposing bottom rim joists; and vertical reinforcing members attached between the top chord and bottom chord of at least one of the opposing side walls;

at least one diagonal reinforcing member attached between the top chord and bottom chord of the at least one of the opposing side walls;

a first set of intersecting reinforcing members comprising a top end of the vertical reinforcing members and the top chord; and a second set of intersecting reinforcing members comprising a bottom end of the vertical reinforcing members and the bottom chord.

16. The modular building unit of claim 15, further comprising:

a third set of intersecting reinforcing members comprising:

a top end of the at least one diagonal reinforcing member, a top end of the vertical reinforcing members and a respective said top rim joist; and a fourth set of intersecting reinforcing members comprising:

a bottom end of the at least one diagonal reinforcing member, a bottom end of the reinforcing members and a respective said bottom rim joist.

17. A modular building unit, comprising:

a floor and a ceiling interconnected by opposing side walls and opposing end walls, which together define a habitable interior;

a plurality of floor trusses disposed within the floor;

a plurality of ceiling trusses disposed within the ceiling;

a plurality of wall studs disposed within the opposing side walls and opposing end walls;

opposing top rim joists attached to opposing ends of the plurality of ceiling trusses;

opposing bottom rim joists attached to opposing ends of the plurality of floor trusses;

a side wall reinforcing structure disposed within at least one of the opposing side walls, the side wall reinforcing structure comprising:

opposing top chords comprising the opposing top rim joists;

opposing bottom chords comprising the opposing bottom rim joists;

at least one vertical reinforcing member attached between the top rim joist and the bottom rim joist of at least one of the opposing side walls and in parallel with at least one of the plurality of wall studs of the at least one of the opposing side walls;

at least one diagonal reinforcing member attached between the top rim joist and the bottom rim joist, wherein the at least one diagonal reinforcing member is attached to the at least one vertical reinforcing member and positioned transverse to one or more of the plurality of wall studs of the at least one of the opposing side walls; and a first set of intersecting reinforcing members comprising:

a top end of the at least one diagonal reinforcing member, a top end of the at least one vertical reinforcing member and the top rim joist; and a second set of intersecting reinforcing members comprising:

a bottom end of the at least one diagonal reinforcing member, a bottom end of the at least one vertical reinforcing member and the bottom rim joist.

* * * * *